US010943531B1

(12) United States Patent
Chen et al.

(10) Patent No.: US 10,943,531 B1
(45) Date of Patent: Mar. 9, 2021

(54) DECAY FACTOR ACCUMULATION METHOD AND DECAY FACTOR ACCUMULATION MODULE USING THE SAME

(71) Applicant: NOVATEK Microelectronics Corp., Hsin-Chu (TW)

(72) Inventors: Li-Chieh Chen, Hsinchu (TW); Yen-Tao Liao, Hsinchu (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 16/891,081

(22) Filed: Jun. 3, 2020

(51) Int. Cl.
*G09G 3/3208* (2016.01)

(52) U.S. Cl.
CPC ... *G09G 3/3208* (2013.01); *G09G 2320/0257* (2013.01); *G09G 2320/0285* (2013.01)

(58) Field of Classification Search
CPC ..... G09G 3/3208; G09G 2320/0257; G09G 2320/0285
See application file for complete search history.

(56) References Cited

U.S. PATENT DOCUMENTS 6,414,661 B1 * 7/2002 Shen ..... G09G 3/3208 345/46
10,714,018 B2 * 7/2020 Zahirovic ..... G09G 5/10

* cited by examiner

*Primary Examiner* — Stacy Khoo
(74) *Attorney, Agent, or Firm* — Winston Hsu

(57) ABSTRACT

The present invention provides a decay factor accumulation method for an organic light-emitting diode (OLED) display panel with a variable refresh rate (VRR). The decay factor accumulation method includes detecting an operating frame rate of an input image; generating a decay factor compensation coefficient according to the operating frame rate and a measurement frame rate; and generating a plurality of accumulated decay factors of the input image according to a decay factor lookup table corresponding to the measurement frame rate and the decay factor compensation coefficient.

12 Claims, 5 Drawing Sheets

DECAY FACTOR ACCUMULATION METHOD AND DECAY FACTOR ACCUMULATION MODULE USING THE SAME

BACKGROUND OF THE INVENTION

1. Field of the Invention

The present invention relates to a decay factor accumulation method and decay factor accumulation module using the same, and more particularly, to a decay factor accumulation method and decay factor accumulation module capable of accurately generate accumulated decay factors for an organic light-emitting diode (OLED) display panel with a variable refresh rate (VRR).

2. Description of the Prior Art

An organic light-emitting diode (OLED) is a light-emitting diode (LED) in which the emissive electroluminescent layer is a film of organic compound, where the organic compound can emit light in response to an electric current. OLEDs are widely used in displays of electronic devices such as television screens, computer monitors, portable systems such as mobile phones, handheld game consoles and personal digital assistants (PDAs). An active matrix OLED (AMOLED), which is driven by a thin-film transistor (TFT) which contains a storage capacitor that maintains the pixel states to enable large size and large resolution displays, becomes the mainstream of the OLED displays.

In a general OLED display, each pixel cell includes an OLED for displaying a gray scale in the pixel. The pixel cell receives a voltage signal from a timing controller. A TFT then converts the voltage signal into a driving current, which drives the OLED to emit light. The luminance of the OLED is determined by the driving current of the OLED. However, in the OLED display, the TFT indifferent pixels may possess an error or mismatch in the device parameter, which may result in different voltage-to-current conversion behaviors. In addition, there may also be a mismatch in the luminous efficiency of the OLED. After a long-time operation, the OLED display may undergo degradations (burn-in) in voltage-to-current conversion and luminous efficiency. Therefore, the uniformity of the OLED display may be influenced since different locations on the OLED display may possess different levels of degradations. Different operating temperatures, OLED material and driving currents will suffer different degradations.

Please refer to FIG. 1, which is a schematic diagram of an operation of conventional decay factor accumulation. As shown in FIG. 1, a memory 10 stores a decay factor lookup table (LUT). When an input image $IMG_1$ is received for display, decay factors of the input image $IMG_1$ are looked up from the decay factor lookup table stored in the memory 10 and output as accumulated decay factors $ADF_1$. Therefore, when a subsequent image is displayed, the subsequent image could be compensated with the accumulated decay factors $ADF_1$ and previous accumulated decay factors resulted from images before the input image $IMG_1$, to compensate degradations.

However, decay factor lookup tables are built up by optical measurements of OLED display panels displaying videos with a fixed frame rate, to look up decay factor accumulation and perform data compensation (e.g. increasing driving current of OLED) thereof to overcome degradations. The decay factor lookup tables storing decay factor only represent accumulation of fixed time (e.g. 1, 2 or 4 frame/second). Since the decay factor lookup tables are derived from a fixed frame rate and thus only store 1 set of decay factors (with fixed time), if the Variable Refresh Rate (VRR) function is applied, the decay factor accumulation will be erroneous.

For example, if a decay factor lookup table is derived from a fixed frame rate of 60 Hz, the decay factor within the decay factor lookup table is for an image displayed with a duration of 1/60 seconds. If the VRR function is applied, an OLED display panel has an operation frame rate of 30 Hz and thus an image would be displayed with a longer duration of 1/30 seconds. Therefore, if the decay factor lookup table derived from the frame rate of 60 Hz is applied for the OLED display panel currently with the operation frame rate of 30 Hz, accumulated decay factors derived from the decay factor lookup table for each image would be much less than actual accumulated decay factors and data compensation would not be enough.

Table 1 shows the error accumulation of the conventional decay factor accumulation. The decay factor lookup table is derived from the frame rate of 60 Hz, while the operation frame rate is 30 Hz. Three videos are displayed as a simulation for a long time, the right column is maximum data compensation value difference compared with correct accumulation (i.e. difference between operation frame rate=30 Hz and operation frame rate=60 Hz by utilizing a decay factor lookup table derived from the frame rate of 60 Hz for decay factor accumulation and data compensation thereof). As can be seen from Table 1, when gray scale values are from 0 to 4095 (i.e. 12 bits), maximum data compensation value differences are 170, 522, 482 for three videos, respectively, resulting in poor data compensation.

TABLE 1

| error accumulation | |
|---|---|
| 30 Hz | Max. Diff (12 bits) |
| Video 1 | 170 |
| Video 2 | 522 |
| Video 3 | 482 |

Thus, there is a need to improve over the prior art.

SUMMARY OF THE INVENTION

It is therefore an objective of the present invention to provide a decay factor accumulation method and decay factor accumulation module using the same capable of accurately generate accumulated decay factors for an organic light-emitting diode (OLED) display panel with a variable refresh rate (VRR).

The present invention discloses a decay factor accumulation method for an organic light-emitting diode (OLED) display panel with a variable refresh rate (VRR). The decay factor accumulation method includes detecting an operating frame rate of an input image; generating a decay factor compensation coefficient according to the operating frame rate and a measurement frame rate; and generating a plurality of accumulated decay factors of the input image according to a decay factor lookup table corresponding to the measurement frame rate and the decay factor compensation coefficient.

The present invention further discloses a decay factor accumulation module for an organic light-emitting diode (OLED) display panel, having a variable refresh rate (VRR).

The decay factor accumulation module includes a detecting circuit, for detecting an operating frame rate of an input image; a decay factor compensation circuit, for generating a decay factor compensation coefficient according to the operating frame rate and a measurement frame rate; and a decay factor accumulation circuit, for generating a plurality of accumulated decay factors of the input image according to a decay factor lookup table corresponding to the measurement frame rate and the decay factor compensation coefficient.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
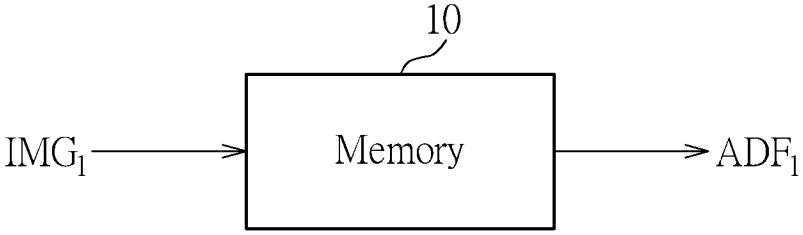
FIG. 1 PRIOR ART
FIG. 1 is a schematic diagram of an operation of conventional decay factor accumulation.
Figure 2:
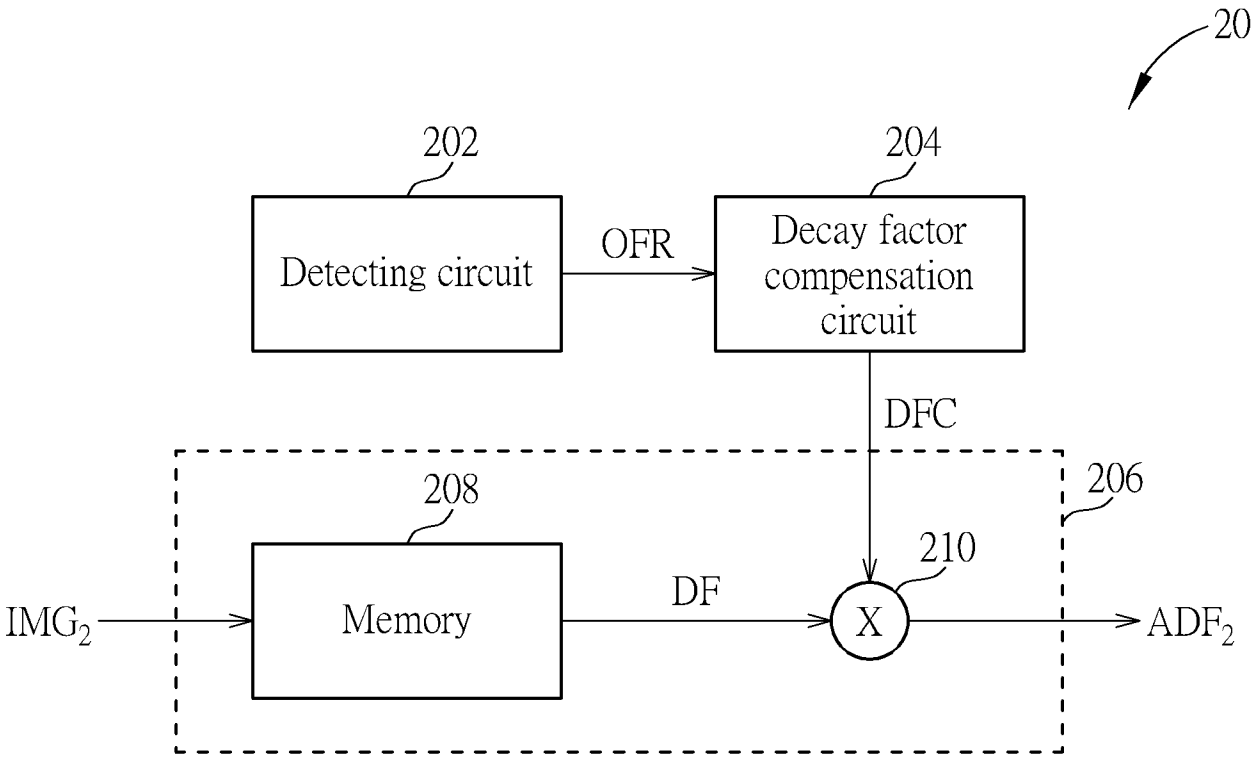
FIG. 2 is a schematic diagram of a decay factor accumulation module according to an embodiment of the present invention.

Please refer to FIG. 2, which is a schematic diagram of a decay factor accumulation module 20 according to an embodiment of the present invention. As shown in FIG. 2, the decay factor accumulation module 20 is utilized for an organic light-emitting diode (OLED) display panel (not shown), and includes a detecting circuit 202, a decay factor compensation circuit 204 and a decay factor accumulation circuit 206, wherein the decay factor accumulation circuit 206 includes a memory 208 and a multiplier 210. In short, the OLED display panel has a variable refresh rate (VRR), such that the OLED display panel utilizes a lower operating frame rate for static operations (e.g. reading documents) and utilizes a higher operating frame rate for dynamic operations (e.g. playing games). The detecting circuit 202 detects an operating frame rate OFR of an input image $IMG_2$. The decay factor compensation circuit 204 generates a decay factor compensation coefficient DFC according to the operating frame rate OFR and a measurement frame rate. The decay factor accumulation circuit 206 generates accumulated decay factors $ADF_2$ of the input image $IMG_2$ according to a decay factor lookup table corresponding to the measurement frame rate and the decay factor compensation coefficient DFC.

Under such a situation, by detecting the operating frame rate OFR of the input image $IMG_2$ and generating the decay factor compensation coefficient DFC according to the operating frame rate OFR and the measurement frame rate, the decay factor accumulation module 20 may modify decay factors DF derived from the decay factor lookup table with the decay factor compensation coefficient DFC to generate the accumulated decay factors $ADF_2$ accurately. As a result, when the variable refresh rate (VRR) is applied, the present invention detects the operating frame rate OFR and generates the accumulated decay factors $ADF_2$ accordingly, such that the OLED display panel may accurately compensate a subsequent image with the accumulated decay factors $ADF_2$.

Specifically, since decay factor accumulation is directly proportional to degradation time (a duration during which the input image $IMG_2$ is actually displayed), the correct degradation time may be derived by detecting the operating frame rate OFR of the input image $IMG_2$. Then, the decay factor compensation circuit 204 generates the decay factor compensation coefficient DFC according to a linear or non-linear relation or magnification between the operating frame rate OFR and the measurement frame rate. For example, if the operating frame rate OFR is 30 Hz and the measurement frame rate is 60 Hz, the decay factor compensation coefficient DFC may be linearly derived as 60/30=2 or non-linearly derived by a function of the operating frame rate OFR and the measurement frame rate (i.e. considering erroneous pixel brightness) as 1.8 or magnified as 2.2 (further compensation for other factors). On the other hand, the decay factors DF of the input image $IMG_2$ are looked up from the decay factor lookup table stored in the memory 208, and the multiplier 210 multiplies the decay factors DF with the decay factor compensation coefficient DFC, to generate the accumulated decay factors $ADF_2$. As a result, when the variable refresh rate (VRR) is applied, the present invention generates the accumulated decay factors $ADF_2$ by adjusting the decay factors DF derived from the decay factor lookup table with actual degradation time (the duration during which the input image $IMG_2$ is actually displayed) such that the OLED display panel may accurately compensate a subsequent image with the accumulated decay factors $ADF_2$ and accumulated decay factors of previous images.

Figure 3:
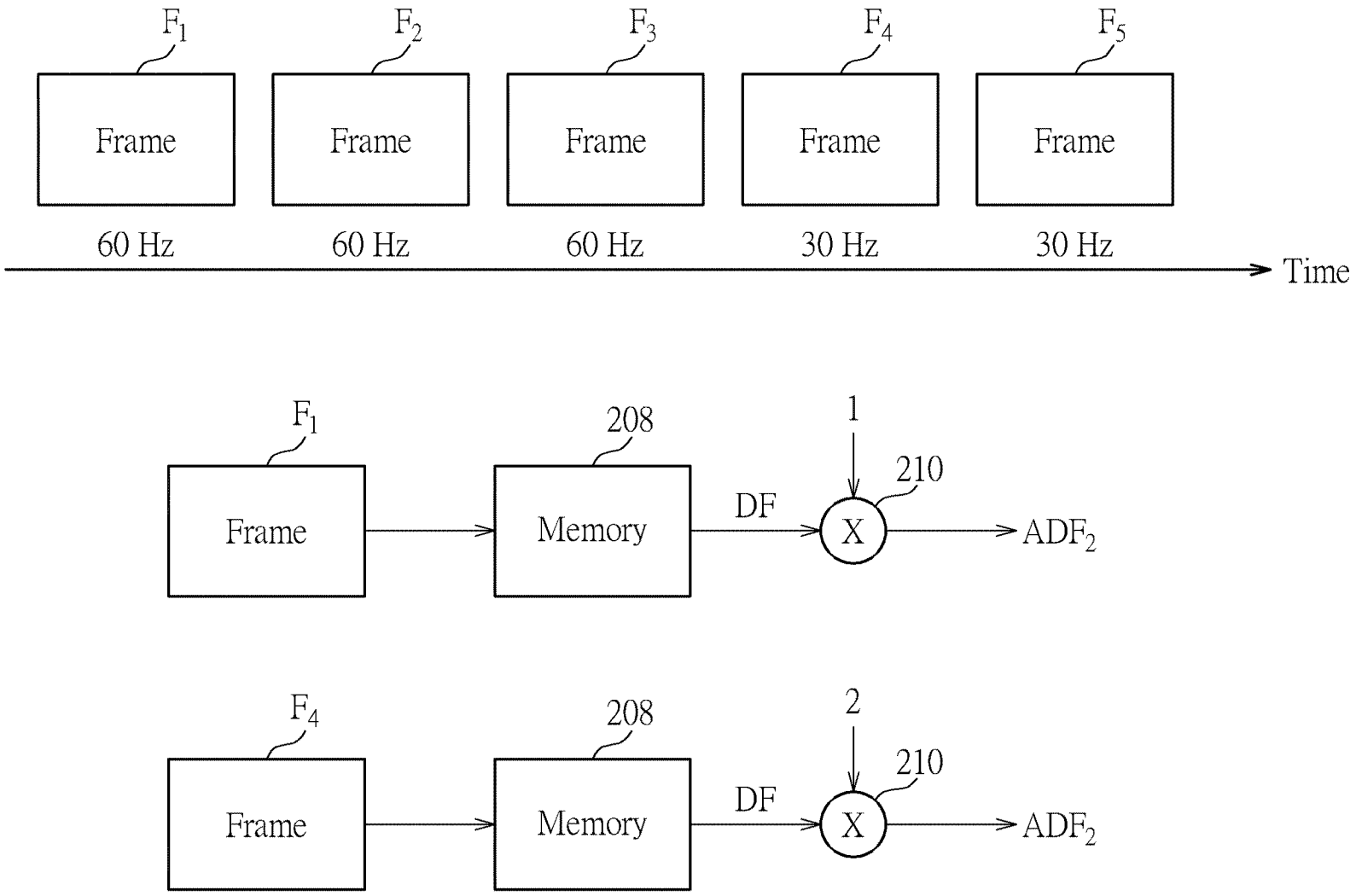
FIG. 3 is a schematic diagram of operations of the decay factor accumulation module shown in FIG. 2 according to an embodiment of the present invention.

For example, please refer to FIG. 3, which is a schematic diagram of operations of the decay factor accumulation module 20. As shown in FIG. 3, the measurement frame rate of the decay factor lookup table stored in the memory 208 is 60 Hz, and 5 frames $F_1$-$F_5$ (images) with the variable refresh rate (VRR) are sequentially received (operating frame rates of frames $F_1$-$F_3$ are 60 Hz and operating frame rates of frames $F_4$-$F_5$ are 30 Hz). Under such a situation, the decay factor compensation coefficient DFC corresponding to the frame $F_1$ may be linearly derived as 60/60=1, i.e. the accumulated decay factors $ADF_2$ is equal to the decay factors DF derived from the decay factor lookup table. On the other hand, the decay factor compensation coefficient DFC corresponding to the frame $F_4$ may be linearly derived as 60/30=2, i.e. the accumulated decay factors $ADF_2$ is two times of the decay factors DF derived from the decay factor lookup table. Noticeably, when the frame $F_2$ is displayed, the OLED display panel performs data compensation (e.g. increasing driving current of OLED) with the accumulated decay factors $ADF_2$ of the frame $F_1$ and accumulated decay factors of previous frames.

Table 2 shows the error accumulation of the present invention. Other conditions are the same with Table 1 except that the decay factor accumulation module 20 is applied rather than the conventional decay factor accumulation. As can be seen from Table 2, when gray scale values are from 0 to 4095 (i.e. 12 bits), maximum data compensation value differences may be dramatically reduced to 40, 63, 75 for the three videos, respectively, thereby performing data compensation accurately and improving image quality.

TABLE 2

| error accumulation | |
|---|---|
| 30 Hz | Max. Diff (12 bits) |
| Video 1 | 40 |
| Video 2 | 63 |
| Video 3 | 75 |

Noticeably, the present invention aims to detect the operating frame rate OFR of the input image $IMG_2$ and adjust the decay factors DF derived from the decay factor lookup table accordingly, to generate the accumulated decay factors $ADF_2$ accurately for compensating subsequent images. Those skilled in the art may make modifications and alterations accordingly. For example, in the above embodiments, the decay factor compensation circuit 204 generates the decay factor compensation coefficient DFC according to a linear or non-linear relation or magnification between the operating frame rate OFR and the measurement frame rate. In another embodiment, the decay factor compensation circuit 204 may generate the decay factor compensation coefficient DFC according to a decay factor compensation lookup table corresponding to the operating frame rate OFR and the measurement frame rate (e.g. the decay factor compensation lookup table could have a linear or non-linear relation or magnification or other relation between the operating frame rate OFR and the measurement frame rate). The embodiments of generating the decay factor compensation coefficient DFC are not limited to these, as long as the decay factor compensation coefficient DFC indicates actual degradation time. Besides, in the above embodiment, the decay factor accumulation circuit 206 includes the multiplier 210 to generate the accumulated decay factors $ADF_2$ by multiplying the decay factors DF with the decay factor compensation coefficient DFC. In another embodiment, the decay factor accumulation circuit 206 includes the multiplier 210 to generate the accumulated decay factors $ADF_2$ according to the decay factor lookup table and the decay factor compensation coefficient DFC in other manners, as long as the decay factors DF derived from the decay factor lookup table are properly adjusted with the decay factor compensation coefficient DFC.

Figure 4:
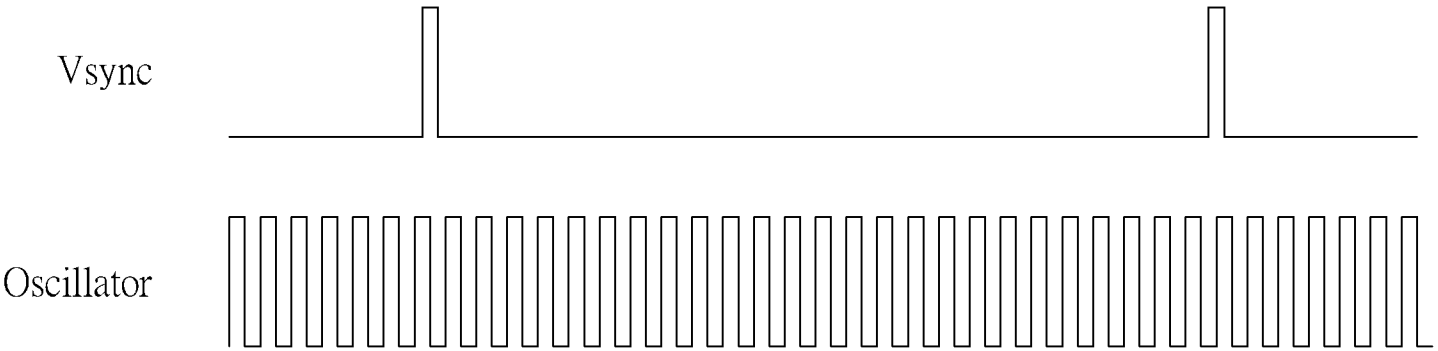
FIG. 4 is a schematic diagram of the detecting circuit shown in FIG. 2 detecting an operating frame rate of an input image $IMG_2$ according to an embodiment of the present invention.

Besides, the manner how the detecting circuit 202 detects the operating frame rate OFR of the input image $IMG_2$ is not limited. For example, please refer to FIG. 4, which is a schematic diagram of the detecting circuit 202 detecting the operating frame rate OFR of the input image $IMG_2$ according to an embodiment of the present invention. As shown in FIG. 4, a period between two pulses of a synchronization signal Vsync is a duration during which the input image $IMG_2$ is displayed. Therefore, the detecting circuit 202 detects an oscillating number of an oscillator during the input image $IMG_2$ displayed (i.e. during the period between two pulses of a synchronization signal Vsync), and calculates the operating frame rate OFR according to the oscillating number n and an oscillating frequency f of the oscillator. That is, the operating frame rate OFR is equal to the oscillating frequency f divided by the oscillating number n, i.e. OFR=f/n.

Figure 5:
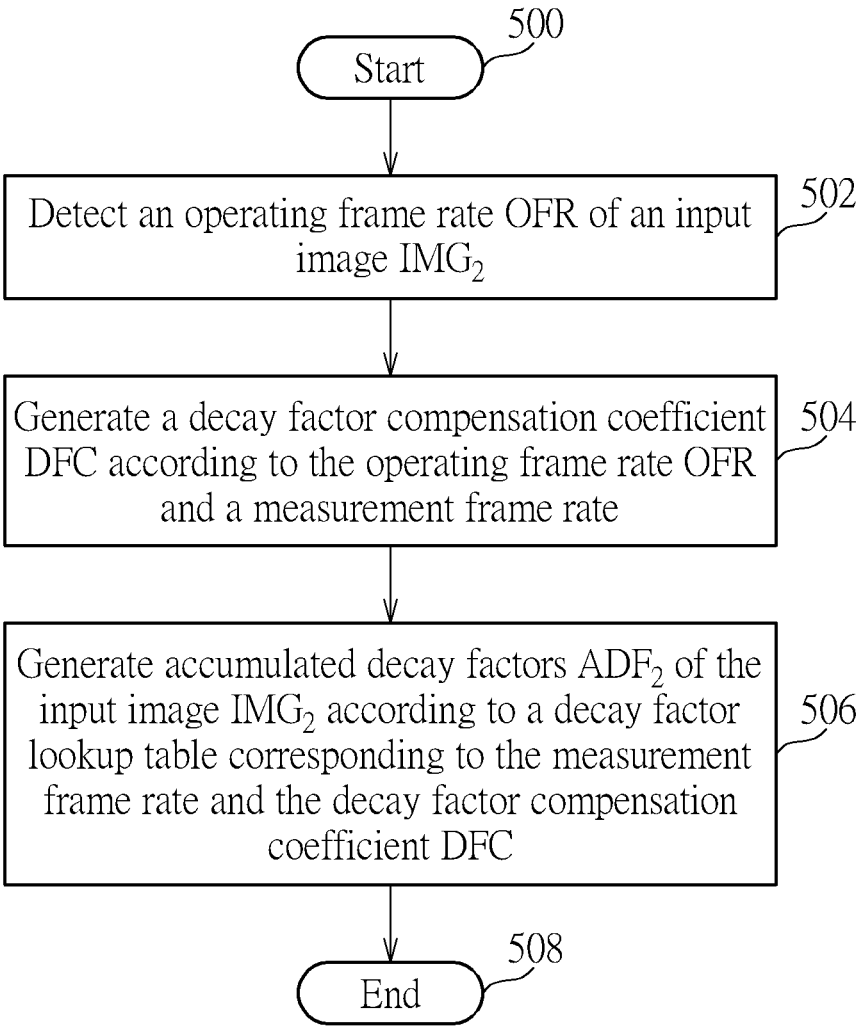
FIG. 5 is a schematic diagram of a decay factor accumulation process according to an embodiment of the present invention.

The above operations of the decay factor accumulation module 20 may be summarized into a decay factor accumulation process 50 shown in FIG. 5. The decay factor accumulation process 50 includes following steps:

Step 500: Start.

Step 502: Detect an operating frame rate OFR of an input image $IMG_2$.

Step 504: Generate a decay factor compensation coefficient DFC according to the operating frame rate OFR and a measurement frame rate.

Step 506: Generate accumulated decay factors $ADF_2$ of the input image $IMG_2$ according to a decay factor lookup table corresponding to the measurement frame rate and the decay factor compensation coefficient DFC.

Step 508: End.

Details of the decay factor accumulation process 40 may be referred to operations of the decay factor accumulation module 20, and are not narrated hereinafter for brevity.

To sum up, for the OLED display panel with a variable refresh rate, the present invention detects the operating frame rate of the input image and adjusts the decay factors derived from the decay factor lookup table accordingly, to generate the accumulated decay factors accurately for compensating subsequent images.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A decay factor accumulation method, for an organic light-emitting diode (OLED) display panel with a variable refresh rate (VRR), comprising:

detecting an operating frame rate of an input image;

generating a decay factor compensation coefficient according to the operating frame rate and a measurement frame rate; and generating a plurality of accumulated decay factors of the input image according to a decay factor lookup table corresponding to the measurement frame rate and the decay factor compensation coefficient.

2. The decay factor accumulation method of claim 1, wherein the step of generating the plurality of accumulated decay factors of the input image according to the decay factor lookup table corresponding to the measurement frame rate and the decay factor compensation coefficient comprises:

looking up a plurality of decay factors of the input image from the decay factor lookup table; and multiplying the plurality of decay factors with the decay factor compensation coefficient, to generate the plurality of accumulated decay factors.

3. The decay factor accumulation method of claim 1, wherein the step of generating the decay factor compensation coefficient according to the operating frame rate and the measurement frame rate comprises:

generating the decay factor compensation coefficient according to a linear or non-linear relation or magnification between the operating frame rate and the measurement frame rate.

4. The decay factor accumulation method of claim 1, wherein the step of generating the decay factor compensation coefficient according to the operating frame rate and the measurement frame rate comprises:

generating the decay factor compensation coefficient according to a decay factor compensation lookup table corresponding to the operating frame rate and the measurement frame rate.

5. The decay factor accumulation method of claim 1, wherein the step of detecting the operating frame rate of the input image comprises:

detecting an oscillating number of an oscillator during the input image is displayed; and calculating the operating frame rate according to the oscillating number and an oscillating frequency of the oscillator.

6. The decay factor accumulation method of claim 1, wherein the OLED display panel compensates a subsequent image with the plurality of accumulated decay factors.

7. A decay factor accumulation module, for an organic light-emitting diode (OLED) display panel with a variable refresh rate (VRR), comprising:

a detecting circuit, for detecting an operating frame rate of an input image;

a decay factor compensation circuit, for generating a decay factor compensation coefficient according to the operating frame rate and a measurement frame rate; and a decay factor accumulation circuit, for generating a plurality of accumulated decay factors of the input image according to a decay factor lookup table corresponding to the measurement frame rate and the decay factor compensation coefficient.

8. The decay factor accumulation module of claim 7, wherein the decay factor accumulation circuit comprises:

a memory, for looking up a plurality of decay factors of the input image from the decay factor lookup table; and a multiplier, for multiplying the plurality of decay factors with the decay factor compensation coefficient, to generate the plurality of accumulated decay factors.

9. The decay factor accumulation module of claim 7, wherein the decay factor compensation circuit generates the decay factor compensation coefficient according to a linear or non-linear relation or magnification between the operating frame rate and the measurement frame rate.

10. The decay factor accumulation module of claim 7, wherein the decay factor compensation circuit generates the decay factor compensation coefficient according to a decay factor compensation lookup table corresponding to the operating frame rate and the measurement frame rate.

11. The decay factor accumulation module of claim 7, wherein the detecting circuit detects an oscillating number of an oscillator during the input image is displayed, and calculates the operating frame rate according to the oscillating number and an oscillating frequency of the oscillator.

12. The decay factor accumulation module of claim 7, wherein the OLED display panel compensates a subsequent image with the plurality of accumulated decay factors.

* * * * *